United States Patent [19]

Aston

[11] 4,396,914

[45] Aug. 2, 1983

[54] ELECTRONIC SECURITY DEVICE

[75] Inventor: Walter J. Aston, Dudley, England

[73] Assignee: Scovill Inc., Waterbury, Conn.

[21] Appl. No.: 279,228

[22] Filed: Jun. 30, 1981

[30] Foreign Application Priority Data

Jul. 1, 1980 [GB] United Kingdom ..... 8021579

[51] Int. Cl.[3] ..... H04Q 9/00

[52] U.S. Cl. ..... 340/825.31; 235/382

[58] Field of Search ..... 340/825.3, 825.31, 825.32, 340/825.33, 825.34; 235/382

[56] References Cited

U.S. PATENT DOCUMENTS

| | | | |
|---|---|---|---|
| Re. 29,259 | 6/1977 | Sabsay . | |
| 3,622,991 | 11/1971 | Lehrer . | |
| 3,761,683 | 9/1973 | Rogers | 340/825.31 |
| 3,800,284 | 3/1974 | Zucker et al. . | |
| 3,848,229 | 11/1974 | Perron et al. | 235/382 |
| 3,859,634 | 1/1975 | Perron et al. | 235/382 |
| 3,860,911 | 1/1975 | Hinman . | |
| 3,862,716 | 1/1975 | Black et al. | 340/825.33 |
| 3,902,342 | 9/1975 | Zucker et al. . | |
| 3,911,397 | 10/1975 | Freeny, Jr. | 340/825.31 |
| 3,926,021 | 12/1975 | Genest et al. | 340/825.31 |
| 4,048,475 | 9/1977 | Yoshida | 340/825.33 |
| 4,177,657 | 12/1979 | Aydin . | |
| 4,207,555 | 6/1980 | Trombly . | |
| 4,310,720 | 1/1982 | Check, Jr. | 340/825.31 |

FOREIGN PATENT DOCUMENTS

| | | |
|---|---|---|
| 1456138 | 11/1976 | United Kingdom . |
| 2020074 | 11/1979 | United Kingdom . |

*Primary Examiner*—Donald J. Yusko

*Attorney, Agent, or Firm*—Ferguson, Baker, Whitham, Spooner & Kroboth

[57] ABSTRACT

An electronic security device includes a memory and a card reader which reads a combination code and calculation data from a key card. An electronic circuit compares the content of the memory with the combination code and enables the lock device if a match is found. If the key card is a new one the circuit calculates a new combination code by applying the calculation data to the memory content and, if this new combination code matches that on the key card the memory is loaded with the new combination code.

11 Claims, 6 Drawing Figures

ELECTRONIC SECURITY DEVICE

BACKGROUND AND SUMMARY OF THE INVENTION

This invention relates to an electronic security device for use, for example, as a door lock.

Various forms of electronic security device are already known, in which a suitably coded key is recognised by an electronic circuit to permit operation of a door bolt. When such a device is used, in a situation where it is desirable regularly to change the code to which the electronic circuit will respond, it becomes necessary to ensure that the circuit and the key currently in use have the same code. This can be achieved by connecting all the electronic circuits to a common control centre, but this is clearly disadvantageous when it is desired to convert the locks of an existing system to electronic locks.

To overcome this problem several solutions have been suggested. One such suggestion is to store in the circuit a fixed sequence of codes and to use each new key to call up the next code of the sequence. Another suggestion utilizes keys each of which has two codes on it, namely the code currently in use and the next code to be used. This next code is stored in the electronic circuit until a new key is used when it is replaced by a 'new' next code.

None of the previously suggested systems provides the ideal solution to the problem. At any given time the "next" code is already established and this casts some doubt on the security of the system.

In accordance with the present invention there is provided an electronic security device including memory device for storing a combination code, a key reading device for reading from a key device data representing both the combination code and calculation data, and an electronic circuit connected to said memory device and to said key reading device and serving to produce an output for releasing a security device when the combination code from the key reader device matches that in the memory and also serving to change the content of the memory to match the combination code from the key reading device when the content of the memory matches a new combination code calculated by the electronic circuit utilizing the existing content of the memory and the calculation data.

The invention is particularly (but not exclusively) applicable to hotel door lock systems and it will readily be appreciated that in such an arrangement it gives many advantages over previously proposed systems. In particular each new combination code can be randomly selected—the appropriate calculation data being worked out at the central key issuing station. Each key contains no information relating to previous or future combination codes and this makes it extremely difficult for a would-be thief to analyze the system and forge a key.

DETAILED DESCRIPTION OF PREFERRED EMBODIMENTS

Figure 1:
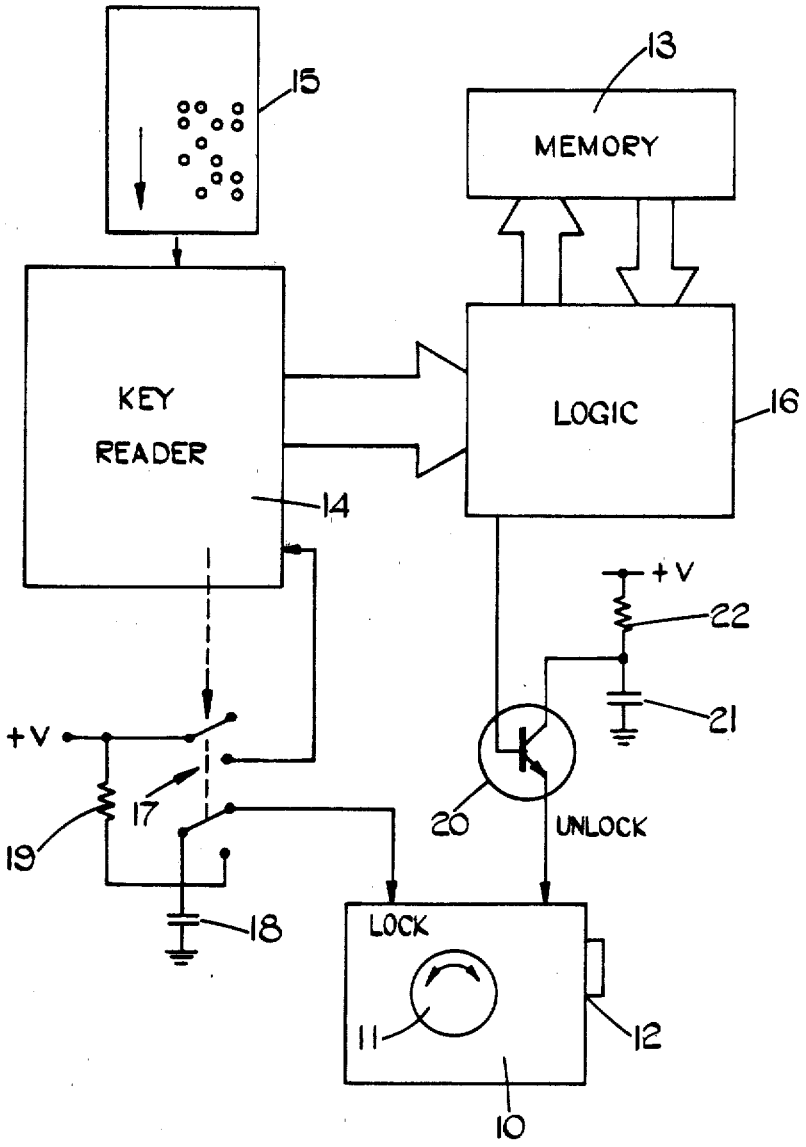
FIG. 1 is a diagrammatic representation of one example of an electronic security device in accordance with the invention.

Referring firstly to FIG. 1, the electronic security device includes a security device 10 which, in the present example, is in the form of a door lock, having a knob or handle 11 used for withdrawing a bolt 12. The lock includes a clutch whereby the knob or handle 11 is mechanically coupled to the bolt 12 and this clutch is electromagnetically actuated, one electromagnet being impulse energised to unlock the door, i.e. to engage the clutch, and another electromagnet being impulse energised to lock the door, i.e. to disengage the clutch.

The electronic security device also includes a memory 13, a key card reader 14 for reading data from a key card 15 and a logic circuit 16 which controls the lock 10 in accordance with the data road from the card 15 and the data stored in the memory 13.

The key card reader 14 includes a $6\times4$ array of infra-red light emitting diodes and a corresponding $6\times4$ array of infra-red sensing devices arranged so that the sensing devices sense radiation from corresponding respective ones of the emitting diodes, when the latter are energised. Holes punched in the card 15, when inserted in the reader 14, permit radiation from some of the emitting diodes to fall on the corresponding sensing devices in known manner so that a 24-bit parallel binary output is provided, suitable amplifiers being provided in the reader 14 if necessary.

A switch 17 operated by a key card fully inserted into the reader 14 connects the emitting diodes to a power supply, so that the diodes are energised when the switch 17 is operated. The switch 17 also controls the charging of a capacitor 18 via a resistor 19 from the power supply and the eventual discharge of this capacitor 18 into the "lock" input of the lock 10, when the key card 14 is removed from the reader 15.

The logic circuit 16 has an output which controls a transistor switch 20 controlling the discharge of another capacitor 21 into the "unlock" input of the lock 10. A resistor 22 provides a permanent charging path for the capacitor 21.

Figure 2:
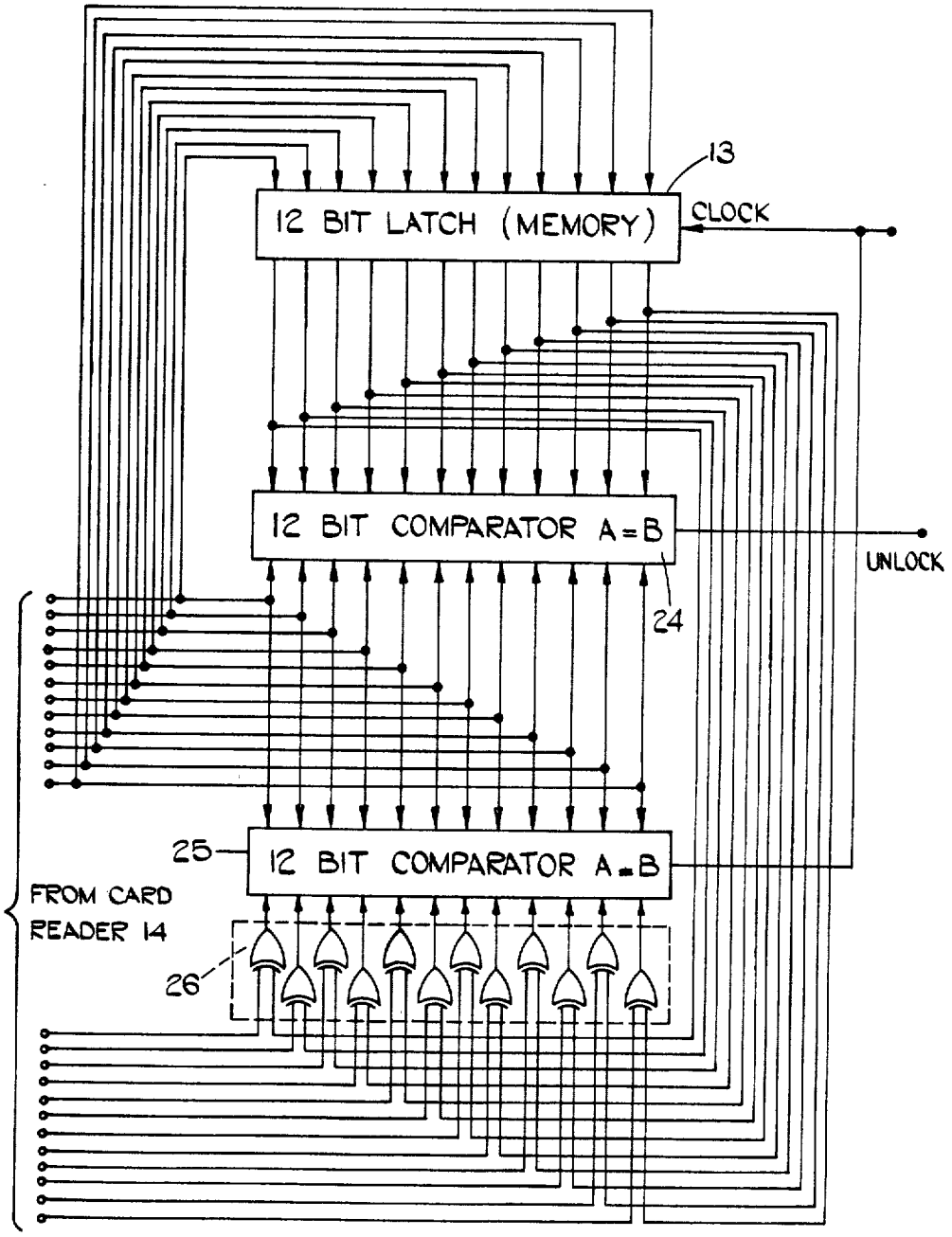
FIG. 2 is a circuit diagram of an electronic circuit forming a part of the electronic security device shown in FIG. 1.

Turning now to FIG. 2 the logic circuit 16 and the memory 13 are shown in more detail therein. The memory 13 consists of a 12-bit latch circuit with its data inputs connected to twelve of the outputs of the reader 14. The logic circuit consists quite simply of two 12-bit digital comparator circuits 24, 25 each having one set of data inputs connected to the same twelve outputs of the reader 14. Comparator 24 has its other data inputs connected to the outputs of the memory 13 and comparator 25 has its other data inputs connected to the outputs of twelve exclusive OR gates 26. Each gate 26 has one input from the memory output another input from an associated one of the other twelve outputs of the reader. The A=B output of comparator 24 provides the "unlock" output of the logic circuit, and the A=B output of comparator 25 is connected to the "CLOCK" input of memory 13.

It will be appreciated that if the twelve output signals of the first twelve outputs the card reader exactly match the twelve bits of data stored in the memory 13, the comparator 13 will produce an "unlock" output causing transistor 20 to turn on so that capacitor 21 discharges into the "unlock" electromagnet. If these outputs match the outputs of gates 26, on the other hand, the output from comparator 25 will clock the memory 13, so that the twelve bit code outputted at the first twelve outputs of the reader will be written into the memory and hold. The output of comparator 24 will then go high to energise the "unlock" electromagnet.

It will be seen that, in the above described embodiment the twelve bit code from the first mentioned twelve outputs of the read represents a key "combination code" which has to match that stored in the lock memory to ensure opening of the door. The twelve bit code from the other twelve outputs of the reader represent a "calculation data" identifying the nature of a mathematical or logical calculation which has to be performed on the existing stored "combination code" to arrive at a new "combination code". The specific calculation in the present case is the inversion of those bits of the 12-bit memory content which coincide with 1 bits of "calculation data".

B.G. if the 12, bit word in the lock memory means is:

0011 1101 0101 1011 the lock will open to a key card with this combination code, or to any other key with compatible combination code and calculation data, for example keys with the following codes,

| Combination | | | | Calculation | | | |
|---|---|---|---|---|---|---|---|
| 0010 | 0100 | 1001 | 1110 | 0001 | 1001 | 1100 | 0101 |
| 0100 | 0000 | 1110 | 1010 | 0111 | 1101 | 1011 | 0001 |

When electronic security devices are used, for example in a hotel door locking system, each new guest can be given a new key card for his room. A control computer keeps in store a listing of the combination codes currently in use for the rooms and, when a new combination code is required, the computer generates calculation data randomly, operates with this data on the existing combination code drawn from the computer store and either prints out a code to be punched in the new key card, or operates an automatic punch to produce the key card.

Figure 3:
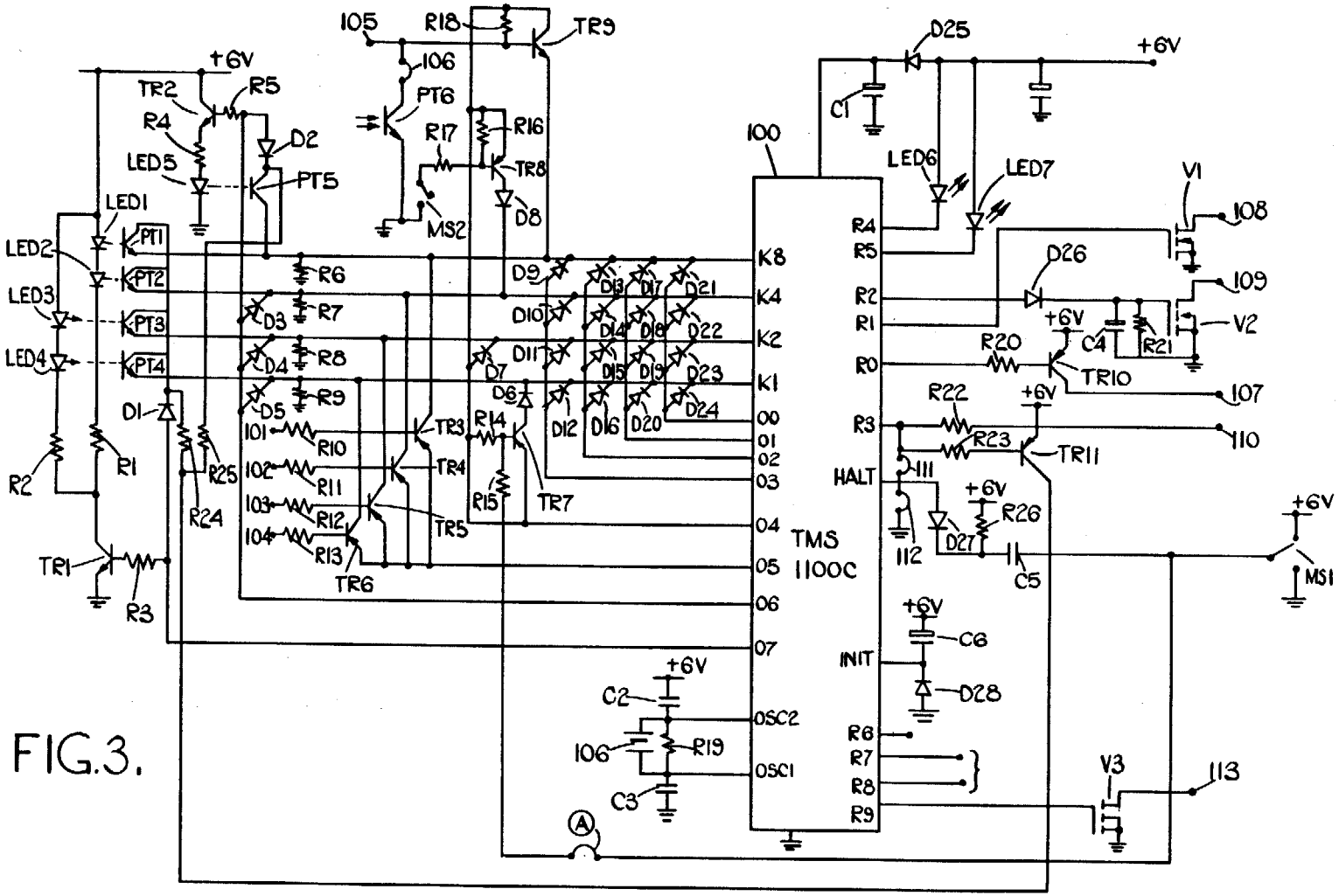
FIG. 3 is the overall circuit diagram of another example of an electronic security device in accordance with the invention and incorporating a microprocessor unit.

The example of the invention shown in FIG. 3 makes use of a microprocessor unit 100. In the example described this unit is a microprocessor type TMS 1100C manufactured by Texas Instruments. This is used to control a card reader incorporating five light emitting diodes LED 1, LED 2, LED 3, LED 4, and LED 5 and five phototransistors PT 1, PT 2, PT 3, PT 4, and PT 5 arranged to receive light only from the associated one of the light emitting diodes. The light emitting diodes LED 1 and LED 2 are connected in series with a resistor R1 and the light emitting diode LED 3 and LED 4 are connected in series with a resistor R2. These two series circuits are connected in parallel with one another between a 6 volt supply rail and the collector of a p.n.p. transistor TR1. The base of this transistor TR1 is connected by a resistor R3 to the 07 output terminal of the microprocessor. This 07 output terminal is also connected via a diode D1 to the collectors of the four phototransistors PT1, PT2, PT3 and PT4. The emitters of the phototransistors PT1, PT2, PT3, and PT4 are connected respectively to the K8, K4, K2 and K1 inputs of the microprocessor.

The light emitting diode LED 5 has its cathode connected to ground and its anode connected via a resistor R4 to the emitter of a p.n.p. transistor TR2 the collector of which is connected to the plus 6 volt rail. The base of transistor TR2 is connected by a resistor R5 to the 06 output of the microprocessor. This 06 output is also connected by a diode D2 to the collector of the phototransistor PT5, the emitter of which is connected to the K8 input of the microprocessor. Load resistors R6, R7, R8 and R9 connect the K8, K4, K2, and K1 terminals of the microprocessor to ground. The 06 output terminal of the microprocessor is also connected by diodes D3, D4 and D5 to the K4, K2 and K1 inputs of the microprocessor.

For providing timer inputs to the microprocessor when required four p.n.p. transistors TR3, TR4, TR5 and TR6 have their emitters connected to the 05 output terminal of the microprocessor and their collectors connected respectively to the K8, K4, K2 and K1 inputs of the microprocessor. The bases of these four p.n.p. transistors are connected to input terminals, 101, 102, 103 and 104 respectively, by resistors R10, R11, R12 and R13.

The 04 output terminal of the microprocessor is connected to the emitter of a p.n.p. transistor TR7 and also via a resistor R14 to the base of this transistor. The collector of transistor TR7 is connected by a diode D6 to the K1 input of the microprocessor. A resistor R15 connects the base of transistor TR7 to the common terminal of a single pole two way micro-switch MS1 operated by insertion of a key card into the key reader. Micro-switch MS1 has its normally closed contact connected to the plus 6 volt line and its normally open contact earthed. The output terminal 04 of the microprocessor is also connected by a diode D7 to the K2 input of microprocessor.

In addition the output terminal 04 of the microprocessor is connected to the emitter of a p.n.p. transistor TR8 the collector of which is connected by a diode D8 to the K4 input of the microprocessor and the base of which is connected by a resistor R16 to the 04 output terminal of the microprocessor and by a resistor R17 to the common pole of another micro-switch which is operated by a "privacy button" situated on the inside of a hotel door on which a locking incorporating this circuit is situated. When the micro-switch MS2 is operated by pressing of this button the resistor R17 grounds the base of the transistor TR8 so as to turn it on whenever the signal at the 04 output of the microprocessor is high.

The 04 output of the microprocessor is also connected to the collector of a p.n.p. transistor TR9 the emitter of which is connected to the K8 input of the microprocessor. the base of this transistor TR9 is connected by a resistor R18 to the 04 output of the microprocessor and is also connected directly to an input terminal 105 which is used when the lock is employed in a system where all the microprocessors are connected by a common data bus to a central processing computer. A link 106 connects the terminal 105 to the collector of a phototransistor PT6 the emitter of which is grounded. The phototransistor PT6 coacts with a light emitting diode in the lock program unit or data transfer unit previously referred to to input data to the microprocessor when required.

A matrix of diodes D9 to D24 connects the 00, 01, 02 and 03 outputs of the microprocessor to the K8, K4, K2 and K1 inputs thereof. These diodes D9 to D24 are selectively removed from each circuit when it is incorporated into a lock to provide that circuit with a 16 bit identification code number, which may be regarded as a four digital hexadecimal number.

The power supply to the microprocessor 100 is derived from the plus 6 volt supply via a diode D25 the anode of which is connected to the 6 volts supply and the cathode which is connected to the supply terminal of the microprocessor. A storage capacitor C1 is connected between the cathode of the diode D25 and earth to ensure a continuity of supply to the microprocessor due to loading on the battery in low battery situations. The capacitor C1 may be replaced by a lithium cell of 3.4 volts nominal voltage.

The operating frequency of the microprocessor is controlled by a circuit connected across the OSC1 and OSC2 terminals of the microprocessor. This circuit consists of two capacitors C2 and C3 connecting opposite ends of a resistor R19 to the 6 volt supply and earth respectively and a ceramic resonator 106 connected across the resistor R19. The two ends of the resistor R19 are connected to the OSC1 and OSC2 terminals.

The R0 output is connected by a resistor R20 to the base of a p.n.p. transistor TR10 which has its emitter connected to the plus 6 volt rail and its collector connected to a terminal 107 which is used when the circuit is employed in a system in which all the circuits ae connected to a central processing unit.

The R1 output of the microprocessor is connected to the gate of a VMOS transistor V1 which has its source terminal grounded and its drain terminal connected to an output terminal 108. The R2 output terminal of the microprocessor is connected via a diode D26 to the gate of a VMS transistor V2 which has its source grounded and its drain connected to an output terminal 109. A resistor R21 and a capacitor C4 are connected in parallel between the gate of the VMOS transistor V2 and ground.

The R3 output of the microprocessor is connected by a resistor R22 to an output terminal 110 and is alos connected by a resistor R23 to the base of a p.n.p. transistor TR11 having its emitter connected to the plus 6 volt rail and its collector connected via a resistor R24 to the cathode of diode D1 and by a resistor R25 to the cathode of diode D2.

The R4 and R5 outputs of the microprocessor are connected by light emitting diodes LED 6 and LED 7 on the exterior of the lock unit to the plus 6 volt rail.

The HALT terminal of the microprocessor is connected by links 111 and 112 to the R3 output and to ground respectively. One of these two links is removed according to the intended mode of operation of the circuit. The HALT terminal is also connected to the anode of a diode D27 the cathode of which is connected to the plus 6 volt rail by a resistor R26. The anode of diode D27 is also connected by a capacitor C5 to the common terminal of the micro-switch MS1.

The INIT terminal of the microprocessor is connected to the cathode of a diode D28 the anode of which is connected to ground and this terminal is also connected via a capacitor C6 to the plus 6 volt rail.

The R9 output of the microprocessor is connected to the gate of a VMOS transistor V3 the source terminal of which is grounded and the drain terminal of which is connected to an output terminal 113.

The key card which is used with the card reader has 10 rows of 5 hole positions. One column of hole positions, namely that corresponding to the position in the key reader of the LED 5 and phototransistor PT5 consists of a complete column of holes providing strobe information as will be explained hereinafter. Entry of a key card into the reader switches the micro-switch MS1 to earth causing a pulse to be applied to the HALT pin of the processor pulling it down to 0 volts briefly. The program in the processor wil then start running and the output R3 of the processor will go low thereby holding the HALT line at 0 volts and allowing the processor to continue to run. In normal operation the processor then reads in the signals on the K1, K2 and K4 inputs whilst outputting pulses from the 04 and 06 outputs. The absence or presence of the link diodes D3,D4, D5, D6 and D7 is then established to enable the processor to treat the input it subsequently receives in an appropriate manner. This is explained in more detail hereinafter. For the purposes of the present explanation we assume that the diode links are such as to indicate operation as a stand alone hotel door lock, i.e. one which is not connected to a central processor.

Strobe pulses then appear on the 06 output to energise LED 5 and enable phototransistor PT5. When a strobe hole is detected as a result of light from LED 5 falling on phototransistor PT5 an output is produced at the 07 output of the processor and the main data read out diodes LED1, LED2, LED3, and LED4 are energised, phototransistors PT1, PT2, PT3, and PT4 being read into the microprocessors K1, K2, K4 and K8 input lines. Strobe pulses and data read pulses are never present at the same time and two identical reads have to occur before the microprocessor will accept valid data. This strobe/read process is continued until 10 lines of data have been read.

If a card is accepted the R4 output goes low and causes LED6 to be energised. A 100 mS pulse then appears on the R1 output and is this followed by a pulse on the R2 output lasting approximately 2.5 seconds. After this pulse another 100 mS duration pulse appears on output R9. The capacitor C4 and Resistor R21 operate to extend the second mentioned pulse for use with some lock mechanisms. The signals at the terminals 108, 109 and 110 can be used by different types of locks. For example some locks may require only the signal at terminal 109 whereas others may require the signal at terminal 108 for unlocking and that at terminal 113 for relocking.

Before the output pulses referred to above are delivered the 05 output is energised and the K lines are read, any voltage present on K1, K2, K4 or K8 preventing operations of codes stored in memory locations, 1, 2, 3, or 4 respectively (explanation follows). A voltage would be available if an external voltage were applied through terminals 101 to 104 by an external timer which prevents certain keys from being used at certain times of day. This external timer facility is optional and may be omitted completely.

Capacitor C6 and diode D28 are used by the microprocessor internally for initialisation purposes.

If it is required to change the contents of the part of the microprocessor RAM in respect of the combination codes stored therein, a special key card having a hexadecimal 7 in each of its 10 lines is used. Upon receipt of this instruction the processor will first read diodes D9 to D24, outputs 00, 01, 02 and 03 being powered up for this purpose. Having read these diodes the accept indicator LED 6 illuminates and data can be fed into the processor on an infra-red beam via phototransistor PT6 and transistor TR9 into the K8 input. This data is ASCII serial data and must commence with the identification number of the particular lock. This serial data will also include lock out status and position of instruction line on subsequent key cards plus the contents of seven combination code locations each containing six hexadecimal characters. The unit which transfer the data (see FIG. 5) can be a small hand held unit using the same microprocessor but connected to use a different section of the program.

The resistors R6, R7, R8 and R9 are used parallel with the input resistances of the microprocessor in order to reduce the effect of ambient light in the reader which causes the logic zero level to rise near to the intermediate voltage level where doubtful logic states occur. Because of the fact that during a reading operation the phototransistors PT1 to PT5 are repeatedly switched, the characteristics of the device become important. When a hole is present in the key card, a fairly clean near-square pulse is developed on the K input lines. However, if the devices are switched on and there is no hole, indicating a logic 0, the effect of internal device capacitance can become apparent in that a pulse occurs on the K lines which has a very fast rise and delays exponentially. Under normal circumstances there is a built-in delay of 3 machine cycles before the microprocessor accepts inputs from the K lines and this is sufficient to negate the effect of the capacitive pulse and still read a correct logic zero state.

One of the side effects of ambient light, however, is to amplify the capacitive pulse (the phototransistor is already partly on). In this type of circuit the amplified capacitive pulse is more likely to cause a read error and a rise in the logic 0 level. To counter act this effect TR11 which is switched by output R3 applies a small constant current to the phototransistors through resistors R24 and R25 whilst the processor is running. This has the effect of charging the capacitance within the device without altering the logic levels on the K lines. The capacitive pulse is thus reduced to a very safe level (virtually eliminated) and data errors cannot occur from this cause.

The various modes of operation of the circuit are set out in the table below. In this table a 1 indicates the presents of the link or diode, a 0 indicates the absence of the link or diode and, where entered, an X indicates that it is immaterial whether that particular link or diode is present or not.

TABLE 1

SUMMARY OF WIRE LINK OPTIONS.

| D3 | D4 | D5 | D7 | A | |
|---|---|---|---|---|---|
| 1 | 1 | 0 | 0 | 1 | Synchronous UART |
| 1 | 1 | 0 | 1 | X | Control signals on time input lines |
| 1 | 0 | 0 | 0 | 1 | Assynchronous UART |
| 0 | 0 | 0 | 1 | 0 | Stand alone front door (base code) apartment systems. |
| 0 | 0 | 0 | 0 | 0 | Stand alone corridor door (apartment systems) |
| 0 | 0 | 0 | X | 1 | Stand alone room door. |

Figure 4:
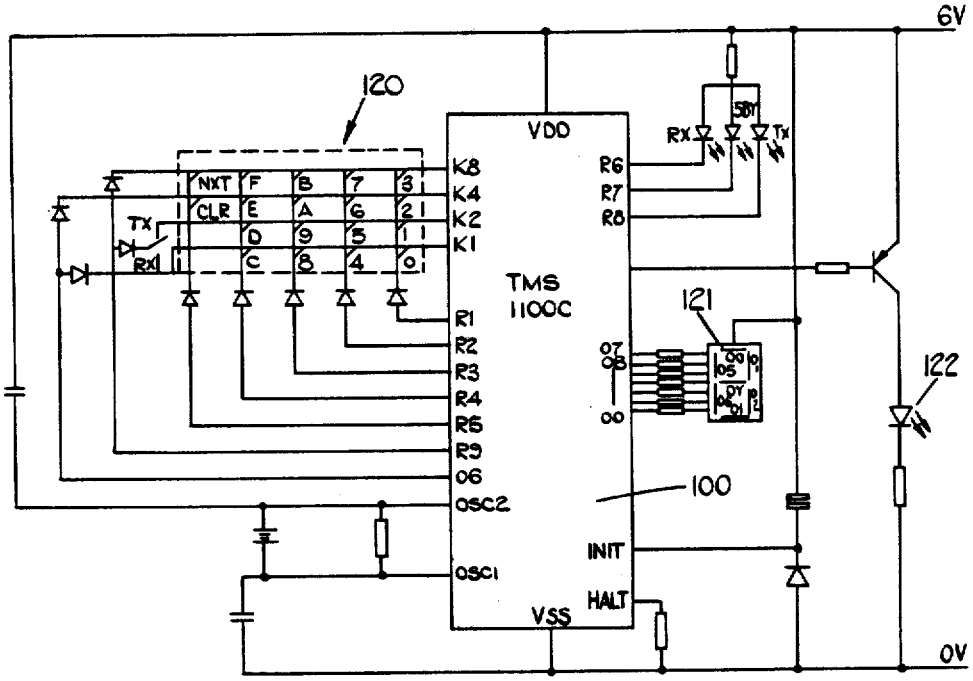
FIG. 4 is a circuit diagram of a lock programming unit incorporating the same microprocessor unit.
Figure 5:
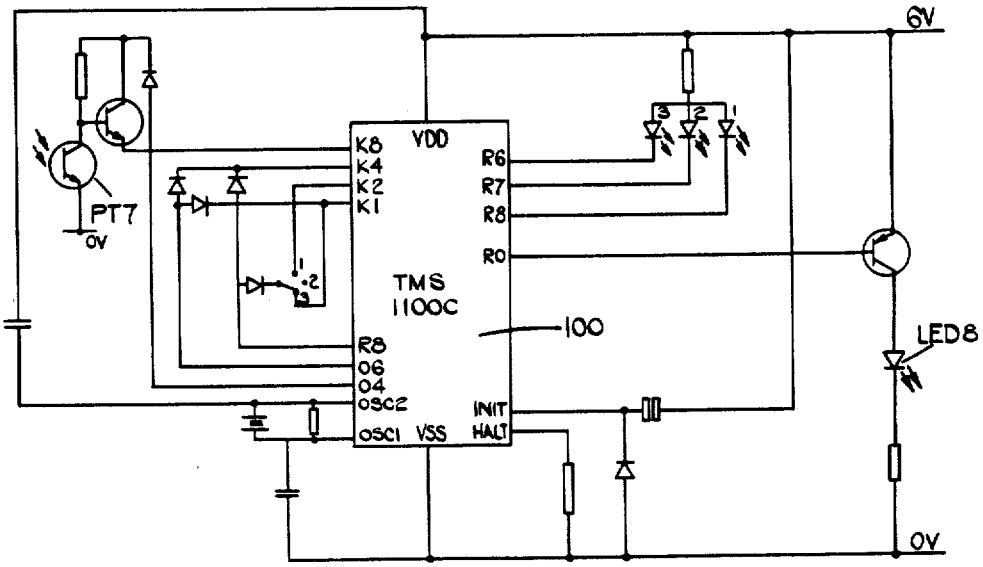
FIG. 5 is a circuit diagram of a data transfer unit including the same microprocessor unit and, FIG. 6 is a circuit diagram of a data transmission unit incorporating the same microprocessor unit.
Figure 6:
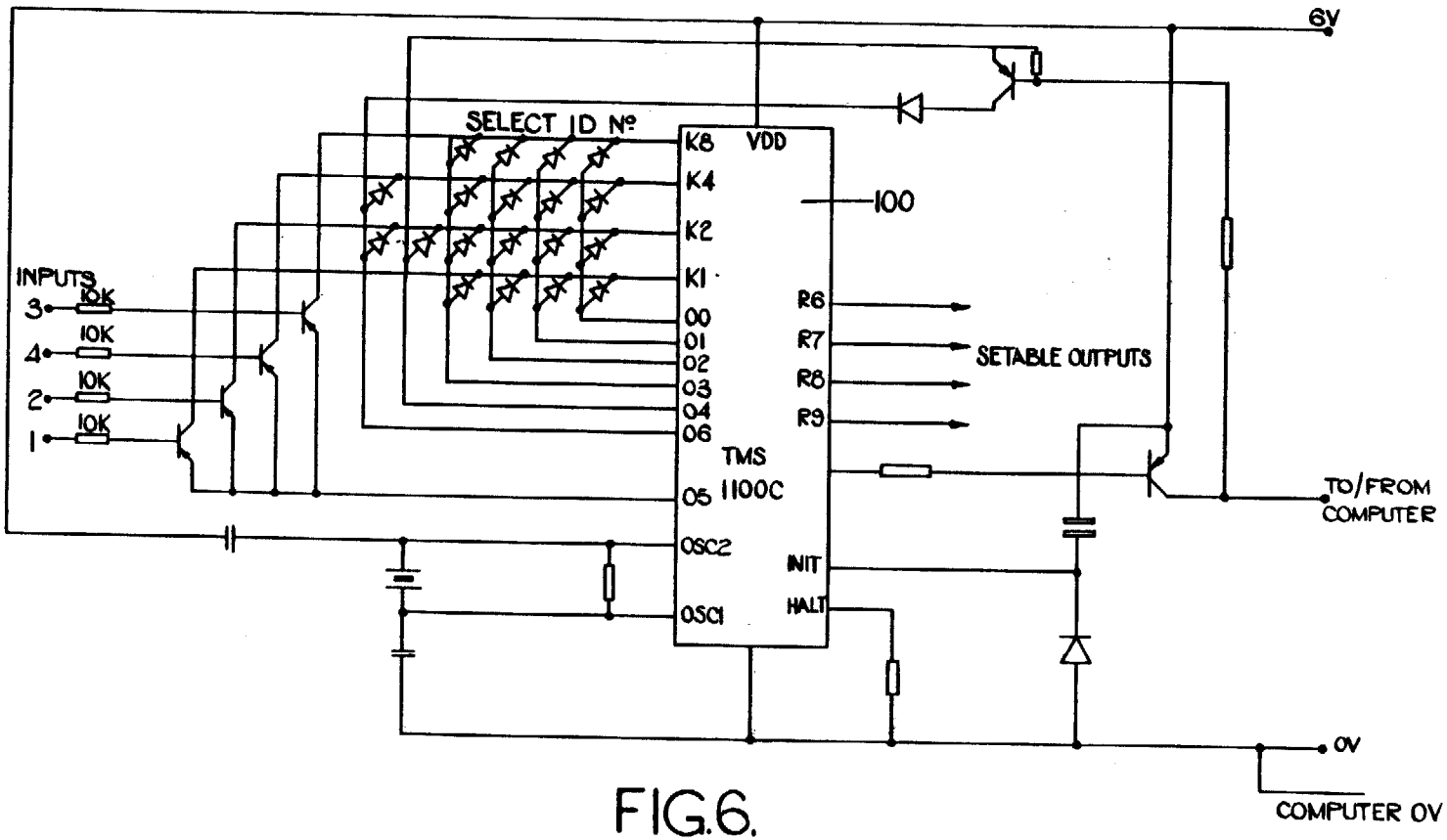

Other link options are available, and these are shown separately in FIGS. 4, 5 and 6. FIG. 4 shows a lock programmer unit which has an integral key board 120 and a display 121 an output into the phototransistor T6 of a door lock circuit via an LED122.

FIG. 5 shows a data transfer unit which can be used as previously mentioned for inserting fresh data into a door lock microprocessor memory, but in this case the unit merely receives input via a phototransistor PT7 from a central computer and, when inserted into the socket in the lock housing utilises a light emitting diode LED8 to transmit data to the phototransistor PT6.

The key card, as mentioned before, has a ten by five array of hole positions, one column of ten holes forming a stroke line. The data in the remaining ten rows of four holes falls into three distinct groups namely, instruction data, combination data and calculation data.

Instruction data consists of one line of information (i.e. one hexadecimal character). The position of this line in relation to other lines will be determined by a single hexadecimal character 1 to 9. The line select character will be stored in the microprocessor's RAM area and is placed there when the lock is first charged with information. The lock microprocessor has, as mentioned above, several selectible fixed functions, (selected by cutting wire links when the lock is installed) and several variable functions. The purpose of the instruction data line is to select the variable function. Variable functions are selected when making the key card as opposed to fixed instructions which are selected by the installer.

A summary of the variable data instructions is set out in table 2 below.

TABLE 2

SUMMARY OF INSTRUCTIONS.

| Code | Instruction. | |
|---|---|---|
| 0 | Display lock out status on LED's (if card carries strobe line only)<br>(a) Both flashing = No lock out<br>(b) Green flashing = Subordinate lock out B<br>(c) Red flashing = Superior lock out A | |
| 0 | One shot key card (if card carries combination and calculation data) operates on combination data stored at location 0 | |
| 1. | Key - combination stored at location 1 | |
| 2. | Key - combination stored at location 2 | |
| 3. | Key - combination stored at location 3 | |
| 4. | Key - combination stored at location 4 | |
| 5. | Key - combination stored at location 5 | |
| 6. | Key - combination stored at location 6 | |
| 7. | Read in serial data to memory from infra red photo-transistor if data starts with correct I.D. number. | |
| 8. | Key - combination stored at location 1 plus lock out B | Subordinate lock out |
| 9. | Key - combination stored at location 2 plus lock out B | |
| A(10) | Key - combination stored at location 3 plus lock out B | |
| B(11) | Key - combination stored at location 4 plus lock out A | Superior lock |

TABLE 2-continued

SUMMARY OF INSTRUCTIONS.

| Code | Instruction. | |
|---|---|---|
| C(12) | Key - combination stored at location 5 plus lock out A | out |
| D(13) | Key - combination stored at location 6 plus lock out A | |
| E(14) | Key - combination stored at location 1 or 2 | Search mode - No calculation data |
| F(15) | Key - combination stored at location 2 or 3 | Code comparison only |

The combination data consists of 6 lines of single hexadecimal characters expressed in binary and provides the main stored code number. The lock will store a total of seven different variable combination code numbers in locations 0 to 6. Six of these are allocatable for normal master keying purposes and the seventh code, 0 is used for so called "one shot" key cards. The instruction line on the key card will tell the microprocessor where to look for the combination data in its RAM storage area. If the correct number is stored in one of the memory areas and the instruction tells the microprocessor to look in the wrong one, the lock will reject the card.

It should be noted that 6 lines of hexadecimal characters allow 16.78 million different combination codes. The calculation code consists of three lines of binary code representing three hexadecimal characters which form a 12 bit algorithm. This algorithm operates on the principle of exclusive OR gating. Binary bits are inverted to select the new number and the algorithm selects the bits which are to be inverted. For example, a card carrying instructions 1 addressing memory location 1 may, for example, have a combination code in hexadecimal 6C4F95 and a calculation code 7B4. This card will operate a lock with the correct combination 6C4F95 stored in memory location 1, but it will also operate a lock with the combination code 4B7044. Rewriting these codes in binary form the combination data on the card is;

0110 1100 0100 1111 1101 0101 the calculation data is;

01 11 10 11 01 00 The stored code in the lock is;

0100 0100 0000 0111 1111 0100

The calculation data identifies which bit of the four bit word representing each hexadecimal character is to be inverted. Where the two bit calculation data corresponding to a four bit binary word is 00 the first bit of the four bit binary word is inverted. Where the two bit combination code is 01 the second bit of the corresponding four bit binary word is inverted, where the code is 10 the third bit is inverted and where the code is 11 the fourth bit is inverted. Thus applying the calculation data shown above to the lock memory code the new combination code calculated matches the combination data on the card.

Where instruction codes 1 to 6 are present data is read from the card while it is being inserted into the card reader. The combination data on the card is compared with the stored combination data in the location indicated by the variable instruction data if the comparison between the key coke and the store code is positive the lock goes into its unlock sequence. If the combination codes did not match, the lock microprocessor would take the stored combination code and apply to it the calculation data from the key card and a new combination code would be generated. A comparison is then made between this new calculated code and the key card combination code. If this comparison is now positive the RAM location indicated by the instruction code would be erased and the new number entered in its place, thus becoming of a new combination code for this memory location. The lock would also enter its unlock sequence. In the case of stand alone locks a card with an instruction code zone can take two forms. Firstly, it could contain no data whatever, i.e. strobe hold only. Alternatively, it could contain both combination and calculation data. In the case where an instruction code zero card contains no data the lock interprets this as an instruction to give details of the lock-out status (to be dealt with in detail later). This status will be indicated on the lock's light emitting diodes. If both light emitting diodes are on continuously, then lock out A and B function are both in use. If diode 6 flashes then lockout B is on. If diode LED 7 flashes lock-out A is on and if both flash no lock-out is on. In these circumstances the lock will not open.

When the card contains combination and calculation data it is a "one shot" key card. This card will work once only and never again. It can be used, for example, by a service engineer who needs access to a particular hotel room once for some maintenance purpose. The sequence is the same as for codes 1 to 6 except that the current code comparison is not made. Even if the card combination were equal to the lock combination the lock would not open. In this instance the calculation data is applied to the lock combination data, a new code is calculated and this is compared with the combination code on the key card. If the two codes agree the memory is up dated and the lock enters its unlock sequence. It will be appreciated that on inserting the key card a second time the application of a calculation data to the stored combination data will not give rise to a match between the new combination data and the combination data on the key.

A key card with instruction code 7 is used when it is required to fill up the memory of a lock in the first instance or when an existing lock gets out of sequence, for example because a key card was issued and never used. The central computer installation which generates the key card were to have a different current code to that which the lock holds in its memory. The hand held unit of FIG. 5 is used for this purpose having previously been loaded from the central computer. When the instruction code 7 is received the microprocessor is readied for the receipt of serial data. The lock responds by flashing on its light emitting diode LED 6 to indicate it is ready. The hand held data transfer unit will then transmit to the lock via an infra-red beam. The data transmitted consists of a sequence of code instructions indicating the identification number of the lock, the status of lock out required, the position of the instruction line on subsequent key cards, and the contents of memory locations 0 to 6.

The lock does not give any acknowledgement of the receipt data, although the light emitting diode LED6 goes out as soon as transmission of data finishes.

Feeding in of data from the hand held unit will not cause the lock to open as only a key card can do this.

Codes 8 to 13 are used on cards to perform exactly the same tasks as codes 1 to 6 and they address the same memory locations within the lock. The difference is that they also control led the "lock-out" functions. Lock-out is a means of instructing the microprocessor to ignore successive key cards. The present system incorporates two different levels of key control lock-out identified as A and B. A is controlled by instruction codes 11, 12 and 13 and B is controlled by instruction codes 8, 9 and 10. Lock-out is a "flip/flop" action. First insertion of the card applies lock out and a second insertion removes the lock-out function and opens the lock provided that the combination data on the card is correct. In the lock out B mode, key instruction codes 8, 9 and 10 address memory locations 1, 2 and 3 exactly the same as instruction codes 1, 2 and 3 as far as the combination data is concerned. In addition codes 8, 9 and 10 will operate a subordinate key lock-out B. For example in a hotel someone with a card coded 2 on the instruction line could also be issued with a card coded 9 instead of or as well as the existing card. First insertion of a 9 card will bring in lock-out B. A second insertion of the card will cancel lock-out and the card operates exactly as if it were a code 2 card. If lock-out B is in operation, access by all cards is excluded except a superior or A lock-out card.

In the case of the lock-out A function the arrangement is much the same as the lock-out B function described above except that a card coded 11, 12 or 13 addresses memory locations 4, 5 or 6 and can always open a correctly coded door lock even if B lock-out is on. In this event B lock-out is not cancelled. If A lock-out is functioning no cards will pass until A lock-out is cancelled with an A card.

Finally a manual lock-out function is provided as previously referred to utilising the switch MS2 shown in FIG. 3. This will cause a lock-out function similar to lock-out B to operate. All cards will be ruled out except lock-out A cards which will still function. This function however will not prevent operation of a card coded 1 on the instruction line. For this reason, instruction 1 can be used when hotel guests are sharing a room so that they will not be locking each other out of the room.

Codes 14 and 15 provide a search mode which is not used in automatic up-date code systems. It is intended rather for master keying systems where key changes are required to control doors already controlled by other change keys of different codings. Calculation data does not apply to these cards, the locks simply reading the instruction line and the combination data.

When code 14 is present the microprocessor compares the combination data on the key card with combination data in memory locations 1 or 2 and if the correct code is in location opens the lock.

Code 15 is the same as code 14 but memory locations 2 and 3 are searched.

Although keys with instruction codes 14 and 15 only have seven lines of data it is still necessary for the key card to be punched with 10 strobe holes. The microprocesor temporarily stores all the data read from the key card before computing operations are carried out.

In the description above the invention has been described mainly in its application to hotel door locking systems. The invention is also, however, applicable in master key systems in apartment blocks. The key card issued to each apartment owner is also required to allow the apartment owner through a communal front door used by all tenants and also to allow the occupiers of flats on any floor through a communal corridor.

In the case of a stand alone apartment doors the wire links which are cut are the same as those which are cut in an hotal type door lock. As long as the same key card is used the lock code will not change.

In the case of the main entrance door the links constituted by link A in FIG. 3 and diodes D3, D4 and D5 are cut. This causes the automatic up-date of the memory from the key card to be prevented. When a key card is inserted, the instruction code directs functions and memory locations just as before but the code is not compared. Instead the calculation data is read and applied to the combination data in the memory and a new code is generated. This is then compared with the code on the key card, and if it compares the lock will open. Up to this point it is operating as it would for a new guest in a hotel. However, in this instance, the lock memory still retains the original code number. There is no up-date memory function. Thus an apartment owner now has access to his own apartment where his key card carries the same combination as the lock and through the main door where, by application of a calculation code from his key card to the combination in the lock, a new code is generated which matches the combination code on his key card. Thus, all the cards in the system are different in respect of their combination codes, but they are all related mathematically via the calculation codes to one combination which forms the combination code for the front door of the building.

In the circuit associated with a corridor door lock the link A and the diode links D4, D5 and D7 are all cut and the microprocessor then carries out a code comparison on the first two hexadecimal characters of the combination code and also a calculation for the remaining four hexadecimal characters. Thus every apartment door on a particular floor must have the same two hexadecimal characters at the start of the combination code. The corridor door has an equivalent to hexadecimal characters stored and the last four characters are the same as the front door base code.

As referred to above the terminals 101 to 104 in FIG. 3 allow the use of a timer to control access. Any sort of external time input signals will suffice but complete control can be achieved by using a programmable clock timer integrated circuit type 302-821 available from R. S. Components Limited.

There are three further modes of operation of locks incorporating the microprocessor in systems in which all the locks are connected to and controlled by a central computer system.

In an asynchronous wired system each of the locks has diodes D4, D5 and D7 removed. The lock is wired to a central computer which is in charge of the interpretation of key card information and unlocking, but the locks are not continuously polled by the computer. This means that the locks can be battery operated. Data is fed out on to a common two wire feed system only when a card is inserted into the lock. The lock microprocessor stills looks for 10 strobe holes in the key card, but the format of the data can vary in accordance with the programme of the central computer. On insertion of the key card the lock remains powered up for approximately 3 seconds during which time the lock will send its data, which is the contents of the key card, and then wait for a reply. If the reply does not arrive during power up then it is lost. Once the lock has been powered down there is no way in which the computer can communicate with it.

In a synchronous wired system each lock has the diode links D5 and D7 removed. In addition link 111 is removed instead of link 112 (which is normally removed for stand alone locks). This leaves the microswitch MS1 connected to the transistor TR11 which is used to detect the entry of a key card into the reader. In this mode the lock microprocessor is powered up at all times and therefore needs to be supplied with external power. The lock would normally be polled by the computer regularly in order to check for data present and the lock would reply to this request.

In the event of a failure of the main computer, each individual lock reverts to "stand-alone" operation utilizing codes stored when the computer was operating.

When the circuit is used in a synchronous four-bit data transmission system (as shown in FIG. 6) all the diode links except link A are cut and the HALT pin is grounded. Data can be inputted via terminals 101 to 104 and a single four-bit word can be sent via the outputs R6 to R9 of the microprocessor. This type of system can be used for controlling such things as burglar/fire alarm systems from the same loop as is used for synchronous locks.

I claim:

1. An electronic security device comprising:

(a) a key means having at least a key combination code and calculation data;

(b) lock memory means for storing a stored combination code;

(c) key reading means for reading from said key means said key combination code and calculation data;

(d) electronic circuit means, connected to said lock memory means and to said key reading means, for (1) comparing the key combination code and the stored combination code, (2) producing an output for releasing a security device when said key combination code from said key reading means matches said stored combination code, (3) calculating a new combination code based upon said stored combination code and said calculation data, (4) comparing the new combination code with the key combination code and (5) producing said output when said new combination code matches said key combination code.

2. An electronic security device as claimed in claim 1, wherein said electronic circuit means further comprises means for changing the stored combination code to said new combination code when said latter match occurs.

3. An electronic security device as claimed in claim 2, wherein:

said key means further includes by-pass instruction data, said key reading means includes means for reading said by-pass instruction data, and said circuit means includes means responsive to said by-pass instruction data for by-passing said first comparison.

4. An electronic security device as claimed in claim 1, wherein:

said key means further includes keying level instruction data identifying one of a plurality of keying levels;

said memory means includes means for storing a plurality of stored combination codes respectively relating to different ones of said keying levels; and said circuit means includes means, responsive to said keying level instruction data, for selecting one of said plurality of stored combination codes.

5. An electronic security device as claimed in claim 1, wherein:

said key means includes a "lock-out" keying level instruction data; and said circuit means includes means, responsive to said "lock-out" keying level instruction data, for preventing production of said output upon subsequent receipt of other keying level instruction data.

6. A method of operating an electronic security device which includes a key with a combination code and calculation data, and a lock having a memory, a key reader, and an electronic circuit connected to said memory and key reader, said method comprising the steps of:

storing a combination code in said lock memory;

reading said key combination code and calculation data into said electronic circuit;

comparing the key combination code and the stored combination code;

producing an output for releasing said security device when said key combination code from said key reader matches said stored combination code;

calculating a new combination code based upon said stored combination code and said calculation data comparing the new combination code with the key combination code; and producing said output when said new combination code matches said key combination code.

7. A method of operating an electronic security device according to claim 6, wherein said second producing step further includes the step of changing the stored combination code to said new combination code when said latter match occurs.

8. A method of operating an electronic security device according to claim 7, wherein said key includes by-pass instruction data, said reading step includes reading said by-pass instruction data and between said reading step and said first comparing step there is an additional step of bypassing said first comparing step when said reading step reads by-pass instruction data from said key.

9. A method of operating an electronic security device according to claim 6, wherein said key includes keying level instruction data, said storing step further includes storing in said lock memory a plurality of stored combination codes respectively relating to different ones of said keying levels, and said reading step includes selecting one of said plurality of stored combination codes in accordance with said keying level instruction data read from said key.

10. A method of operating an electronic security device according to claim 9, wherein said keying level instruction data includes a "lock-out" data and said reading step further includes preventing production of said output on subsequent receipt of other keying level instruction data when said "lock-out" data is read.

11. An electronic security device comprising:

(a) a key means having a plurality of keying level instructions one of which is a combination code and another of which is a "lock-out" keying level instruction data;

(b) lock memory means for storing a stored combination code;

(c) key reading means for reading from said key means said key combination code and "lock-out" keying level instruction data, (d) electronic circuit means, connected to said lock memory means and to said key reading means, for (1) comparing the key combination code and the stored combination code, (2) producing an output for releasing a security device when said key combination code from said key reading means matches said stored combination code, (3) preventing production of said output upon subsequent receipt of non-"lock-out" keying level instruction data.

* * * * *